US009625170B2

(12) United States Patent
Aquino

(10) Patent No.: US 9,625,170 B2
(45) Date of Patent: Apr. 18, 2017

(54) EFFICIENT COMBINATION OF AMBIENT AIR AND HEATING, VENTILATING, AND AIR CONDITIONING (HVAC) SYSTEM

(71) Applicant: Antonio Aquino, Los Angeles, CA (US)

(72) Inventor: Antonio Aquino, Los Angeles, CA (US)

( * ) Notice: Subject to any disclaimer, the term of this patent is extended or adjusted under 35 U.S.C. 154(b) by 0 days.

(21) Appl. No.: 14/657,497

(22) Filed: Mar. 13, 2015

(65) Prior Publication Data

US 2015/0184884 A1 Jul. 2, 2015

Related U.S. Application Data

(60) Provisional application No. 62/100,755, filed on Jan. 7, 2015.

(51) Int. Cl.

| | |
|---|---|
| ***G05D 23/00*** | (2006.01) |
| ***F24F 7/00*** | (2006.01) |
| ***F24F 11/00*** | (2006.01) |
| ***F24F 11/053*** | (2006.01) |

(52) U.S. Cl.

CPC ..... *F24F 11/0012* (2013.01); *F24F 11/0001* (2013.01); *F24F 11/0076* (2013.01); *F24F 11/053* (2013.01); *F24F 2011/0002* (2013.01); *F24F 2011/0006* (2013.01); *F24F 2011/0013* (2013.01)

(58) Field of Classification Search

CPC ..... F24F 2011/0013; F24F 2221/34; F24F 11/08; F24F 11/053; F25D 17/045

USPC ..... 62/180, 186, 98, 202; 165/291, 288; 454/229, 239, 256, 269; 236/37, 38, 236/49.1, 49.3, 91 R, 91 D

See application file for complete search history.

(56) References Cited

U.S. PATENT DOCUMENTS

| | | | | |
|---|---|---|---|---|
| 3,753,184 | A | 8/1973 | Holloway et al. | |
| 3,799,245 | A * | 3/1974 | Ferdelman | 165/265 |
| 4,018,266 | A | 4/1977 | Kay | |
| 4,136,822 | A | 1/1979 | Felter | |
| 4,987,952 | A | 1/1991 | Beal et al. | |
| 5,000,381 | A | 3/1991 | Mueller et al. | |
| 5,005,636 | A * | 4/1991 | Haessig | F24F 3/00 165/214 |
| 5,065,585 | A | 11/1991 | Wylie et al. | |
| 5,239,834 | A * | 8/1993 | Travers | 62/151 |
| 5,626,288 | A | 5/1997 | Huber | |

(Continued)

*Primary Examiner* — Ryan J Walters
*Assistant Examiner* — Jason Thompson
(74) *Attorney, Agent, or Firm* — Kenneth L. Green; Averill & Green

(57) ABSTRACT

A wall fan includes a control circuit both controlling the wall fan and a temperature control unit comprising a heater, a cooler, or a Heating, Ventilating, and Air Conditioning (HVAC) system. The control system receives a desired temperature and compares the desired temperature to an outdoor temperature. When the outdoor temperature indicates that drawing outside air into indoor space will drive the indoor air temperature towards the desired temperature, the control system activates the wall fan, and de-energizes the heater, cooler, or HVAC system. When the outdoor temperature indicates that drawing outside air into indoor space will not drive the indoor air temperature towards the desired temperature, the control system de-energizes the wall fan, and energizes the heater, cooler, or HVAC system.

19 Claims, 7 Drawing Sheets

(56) References Cited

U.S. PATENT DOCUMENTS

| | | | | |
|---|---|---|---|---|
| 6,283,851 | B1 | 9/2001 | Smith et al. | |
| 6,364,024 | B1 | 4/2002 | Dallas | |
| 8,079,898 | B1 | 12/2011 | Stevenson | |
| 8,118,236 | B2 | 2/2012 | Lestage et al. | |
| 8,156,797 | B2 | 4/2012 | Murray et al. | |
| 8,543,244 | B2 * | 9/2013 | Keeling et al. | 700/276 |
| 2006/0273183 | A1 | 12/2006 | Cavanagh et al. | |
| 2008/0054085 | A1 | 3/2008 | Case | |
| 2009/0013703 | A1 * | 1/2009 | Werner | 62/180 |
| 2009/0014545 | A1 | 1/2009 | Horiuchi | |
| 2011/0159795 | A1 * | 6/2011 | Sprague | H05K 7/20181 454/184 |
| 2012/0190292 | A1 * | 7/2012 | Skrepcinski | F24F 7/007 454/258 |

* cited by examiner

EFFICIENT COMBINATION OF AMBIENT AIR AND HEATING, VENTILATING, AND AIR CONDITIONING (HVAC) SYSTEM

CROSS-REFERENCE TO RELATED APPLICATIONS

The present application claims the priority of U.S. Provisional Patent Application Ser. No. 62/100,755 filed Jan. 7, 2015, which application is incorporated in its entirety herein by reference.

BACKGROUND OF THE INVENTION

The present invention relates to wall fans and in particular to a heating and cooling system with a temperature differential switch, the system configured to use the outside air to heat or cool a space when the temperature of the outside air is favorable rather than operating a heater or a cooler, or a Heating, Ventilating, and Air Conditioning (HVAC) system.

The cost of heating and air conditioning can be a substantial burden to users. Also, conventional heating and air conditioning systems create a carbon footprint damaging the environment. Conventional HVAC systems generally cycle a refrigerant to cool air or use a heater to heat air, and then circulate the cooled or heated air to various rooms. However, when a heater, a cooler, or an HVAC system is operating, and ambient outdoor air may also be available to drive indoor temperature a desired indoor temperature, known heaters, coolers, and HVAC systems do not take advantage of the potential energy savings.

Therefore, what is needed is a system which, depending on a desired indoor temperature and current outdoor temperature, will either draw the outdoor air into the indoor space when the outdoor air temperature is favorable, or will heat or cool indoor air when the outdoor air temperature is not favorable.

BRIEF SUMMARY OF THE INVENTION

The present invention addresses the above and other needs by providing a wall fan which includes a control circuit both controlling the wall fan and a temperature control unit comprising a heater, a cooler, or a Heating, Ventilating, and Air Conditioning (HVAC) system. The control system receives a desired temperature and compares the desired temperature to an outdoor temperature. When the outdoor temperature indicates that drawing outside air into indoor space will drive the indoor air temperature toward the desired temperature, the control system activates the wall fan, and de-energizes the temperature control unit. When the outdoor temperature indicates that drawing outside air into indoor space will not drive the indoor air temperature toward the desired temperature, the control system de-energizes the wall fan, and energizes the heater, cooler, or HVAC system In accordance with one aspect of the invention, there is provided a heating and cooling system including a wall fan drawing outdoor air into a room to help a room temperature reach a desired temperature. The system includes a human interface for programming the desired indoor temperature, an indoor temperature sensor for measuring the actual indoor temperature, an outdoor temperature sensor for measuring the outdoor temperature, and a microprocessor electrically connected to the temperature sensors. The microprocessor may compare: (i) the indoor temperature with the desired temperature to determine whether the system needs to change the indoor temperature to reach the desired temperature, and (ii) if a change is required, compare the outdoor temperature, the indoor temperature, and the desired temperature to determine whether there is an advantage in drawing outdoor air into the room to obtain the desired temperature. The microprocessor may be connected to a relay switch configured to power either a fan or activate a heater, a cooler, or an HVAC system, depending on whether the outdoor temperature is favorable.

In accordance with another aspect of the invention, there is provided a method for controlling a heating system including a wall fan and a temperature control unit comprising one of a heater and an HVAC system. The method includes: setting heating mode and a low temperature Tl and a high temperature Th; measuring an outdoor temperature To and an indoor temperature Ti; comparing To and Ti, If To is not greater than Ti, de-energize the wall fan and energize the temperature control unit, waiting a period of time P and then repeating measuring the outdoor temperature To and the indoor temperature Ti, otherwise, if To is greater than Ti (i.e., can use outdoor air to heat the room), if Tl is less than Ti and Ti is less than Th, energize the wall fan and de-energize the temperature control unit, or alternatively de-energize the wall fan and energize the temperature control unit; and after the period of time P, again measuring the outdoor temperature To and the indoor temperature Ti and repeating the method. The temperature Tl is a lower preferred indoor temperature and the temperature Th is a higher preferred indoor temperature.

In accordance with yet another aspect of the invention, there is provided a method for controlling a cooling system including a wall fan and a temperature control unit comprising one of a cooler and an HVAC system. The method includes: setting cooling mode and the lower temperature Tl and the higher temperature Th; measuring an outdoor temperature To and an indoor temperature Ti; comparing Ti and To; If Ti is not greater than To, de-energize the wall fan and energize the temperature control unit; waiting a period of time P, and then repeating measuring the outdoor temperature To and the indoor temperature Ti; otherwise, if Ti is greater than To (i.e., can use outdoor air to cool the room), if Tl is less than Ti and Ti is less than Th, energize the wall fan and de-energize the temperature control unit or alternatively de-energize the wall fan off and energize the temperature control unit; and after the period of time P, again measuring the outdoor temperature To and the indoor temperature Ti and repeating the method.

In accordance with still another aspect of the invention, there is provided a wall fan including a control circuit configured to control an HVAC system. The control circuit receives outdoor temperature, indoor temperature, and a desired temperature. When outside air can drive the indoor temperature towards the desired temperature, the control circuit sends a signal to the HVAC system, or the HVAC thermostat, to deactivate the HVAC system to save energy. The wall fan and control circuit are advantageously an add-on to an existing HVAC system.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Various references are made to energizing and de-energizing a wall fan or a temperature control unit. Such energizing and de-energizing refers to providing operating power, and the actual operation of the wall fan or a temperature control unit remains under the control of settings applied to the wall fan or a temperature control unit. Additionally, energizing and de-energizing may also refer to sending a signal to a control element (e.g. a thermostat) controlling the temperature control unit which overrides any mechanical or electrical programming which turns the temperature control unit ON.

Figure 1:
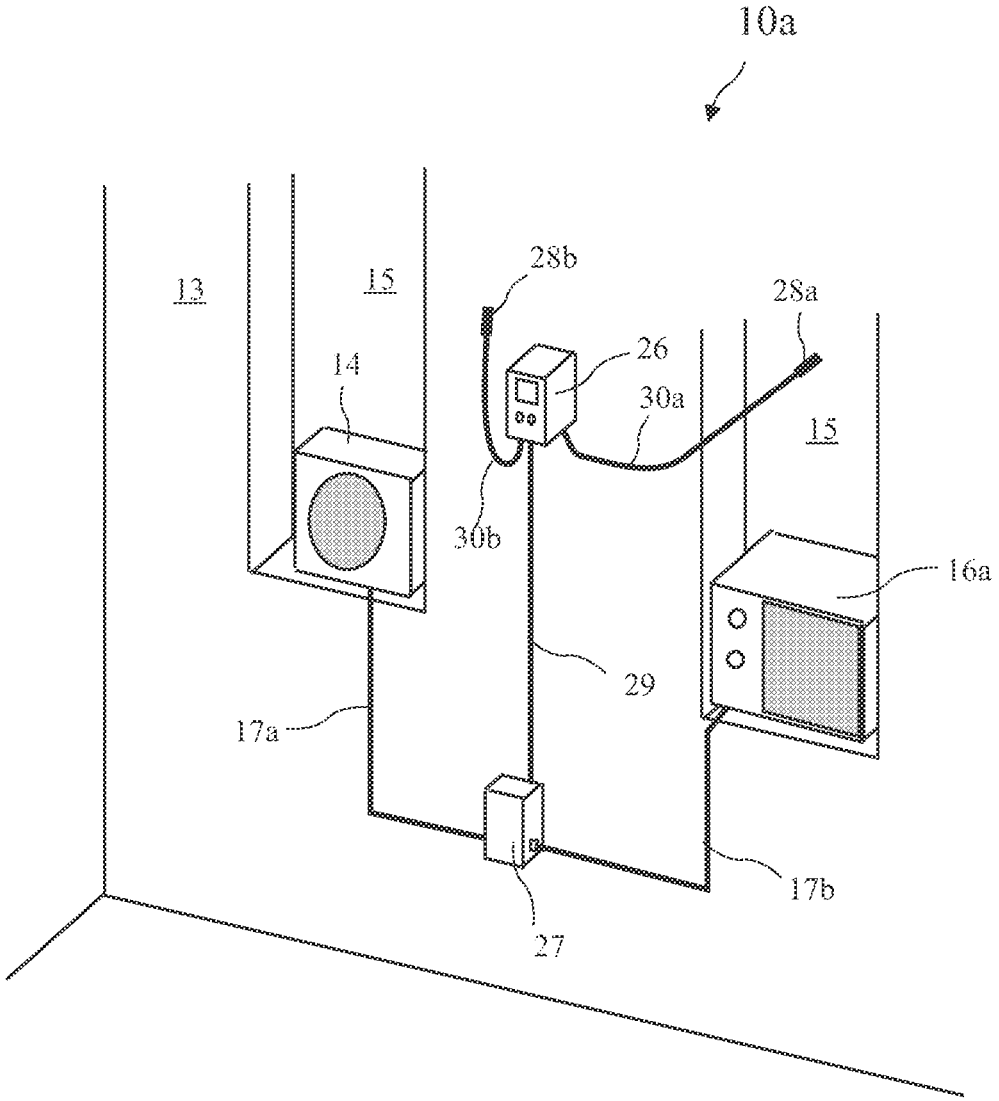
FIG. 1 shows rooms including a wall fan cooperating with a window heating or cooling unit according to the present invention.

A temperature controlled area 10*a* including a wall fan 14 cooperating with a window heating or cooling unit 16*a* according to the present invention are shown in FIG. 1. The wall fan 14 and temperature control unit 16*a* are mounted to an external wall 13, preferably in windows 15. A control panel 26 may be mounted to the wall or be part of wall fan 14. The control panel 26 allows a user to select heating or cooling, and lower temperature Tl and a higher temperature Th determining when and if the wall fan or the heating/cooling unit will be utilized. An outdoor temperature sensor 28*a* measures outdoor temperature To and in indoor temperature sensor 28*b* measures an indoor temperature Ti. The temperatures Tl and Th, To, and Ti are all provided to a processor 50 (see FIG. 7). The temperature control unit 16*a* may be a heating and/or cooler.

Figure 3:
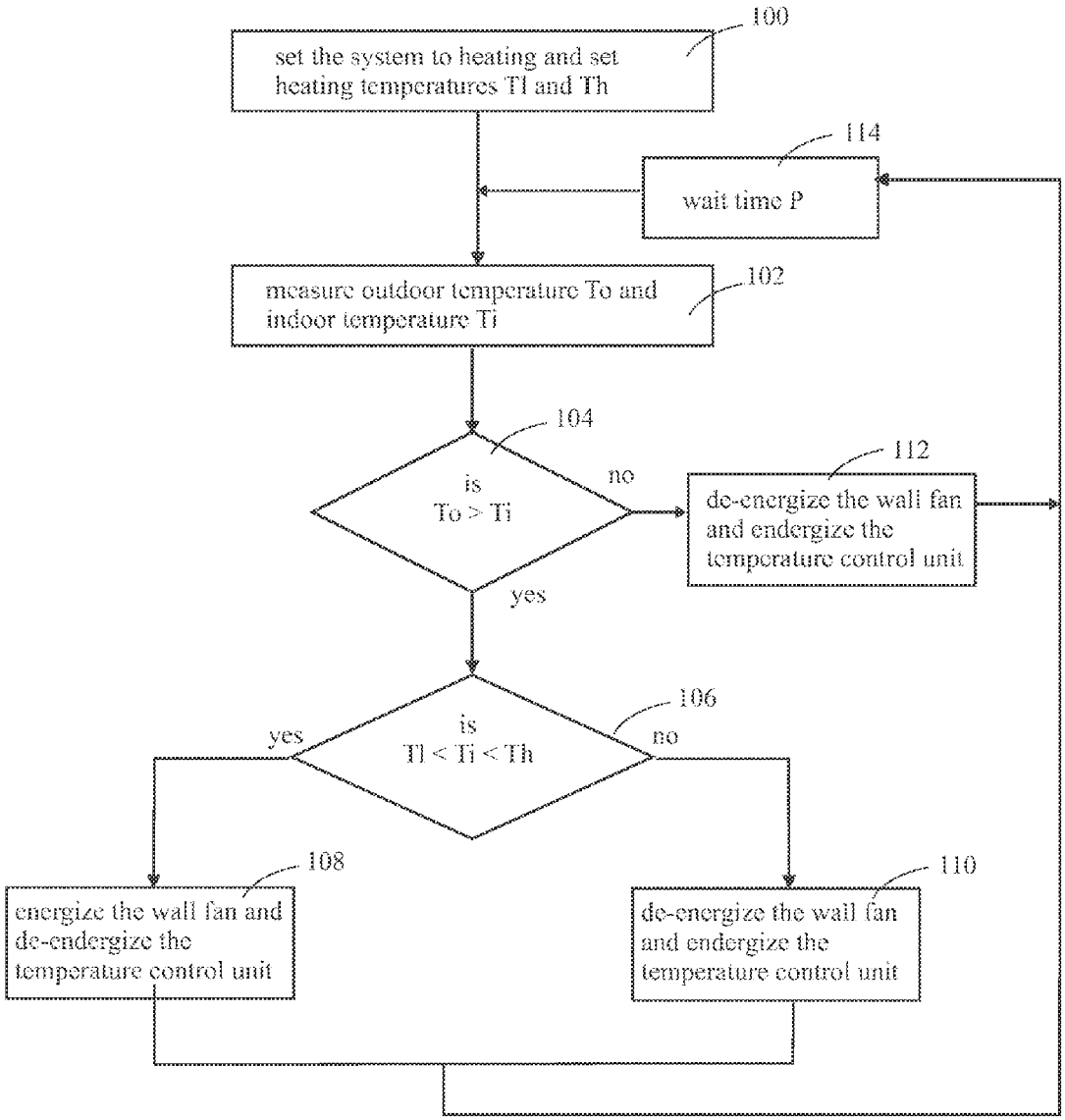
FIG. 3 shows a heating method according to the present invention.
Figure 5:
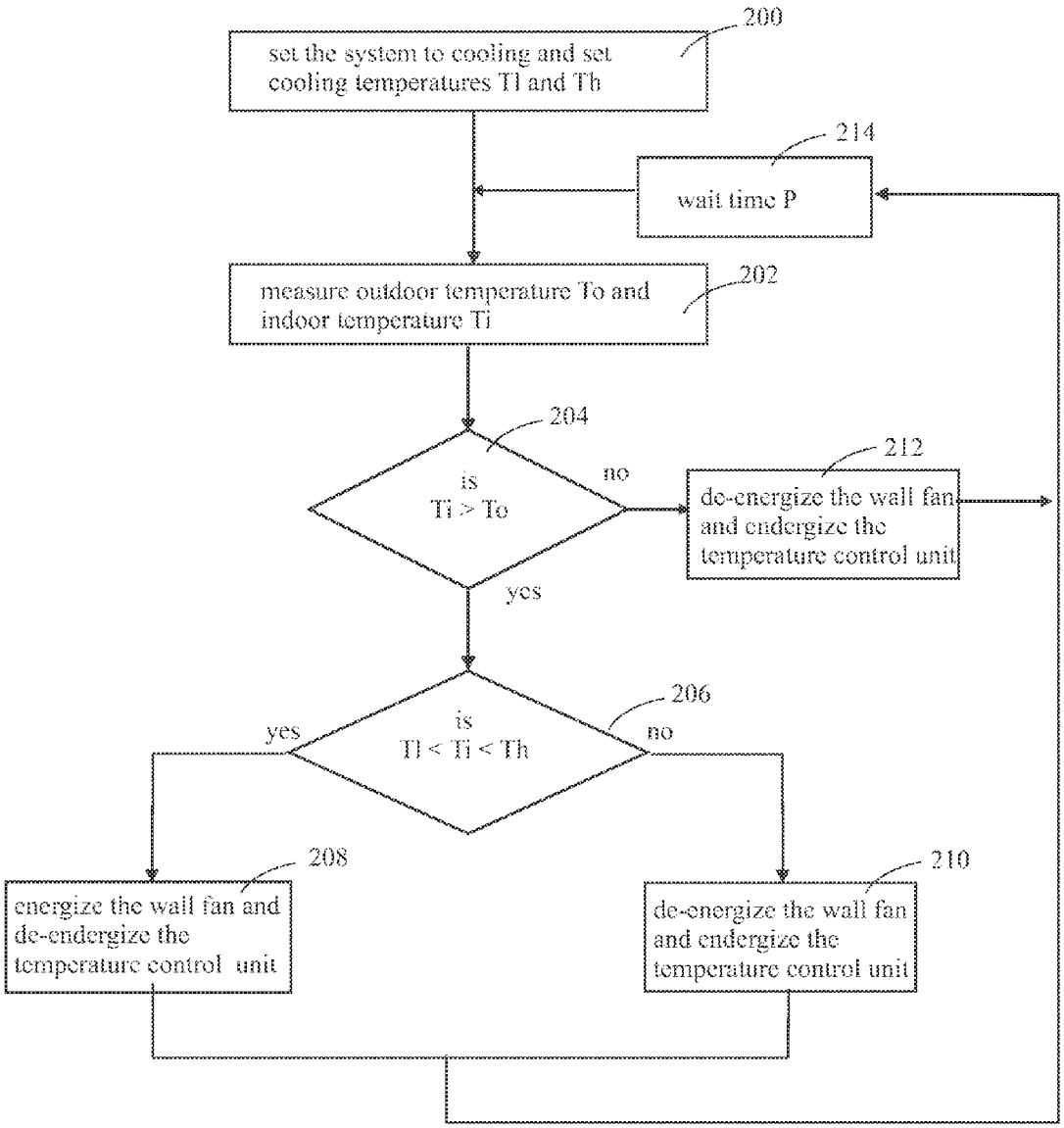
FIG. 5 shows a cooling method according to the present invention

The processor 50 determines if the wall fan 14 should be energized or de-energized, and if the heating/cooling unit 16*a* should be de-energized or energized, based on the method of FIGS. 3 and 5. The sensors 28*a* and 28*b* are connected to the control panel 26 by wires 30*a*, 30*b*. The control panel 26 controls the switch 27 which includes relays or the like, and the switch 27 controls power provided to the window fan 14 and the heating/cooling unit 16*a*. For example, the switch 27 may include a normally open, double throw relay, and a relay contact will flip from a wall fan cord 17*a* to a heater/cooling unit cord 17*b* when a signal is receive from the control panel 26. In other embodiments, the temperature sensors 28*a* and 28*b* may be connected to the switch 27, and the switch 27 may include a control circuit. When the heating/cooling unit 16*a* receives power, it will operate based on its normal operation.

Figure 2:
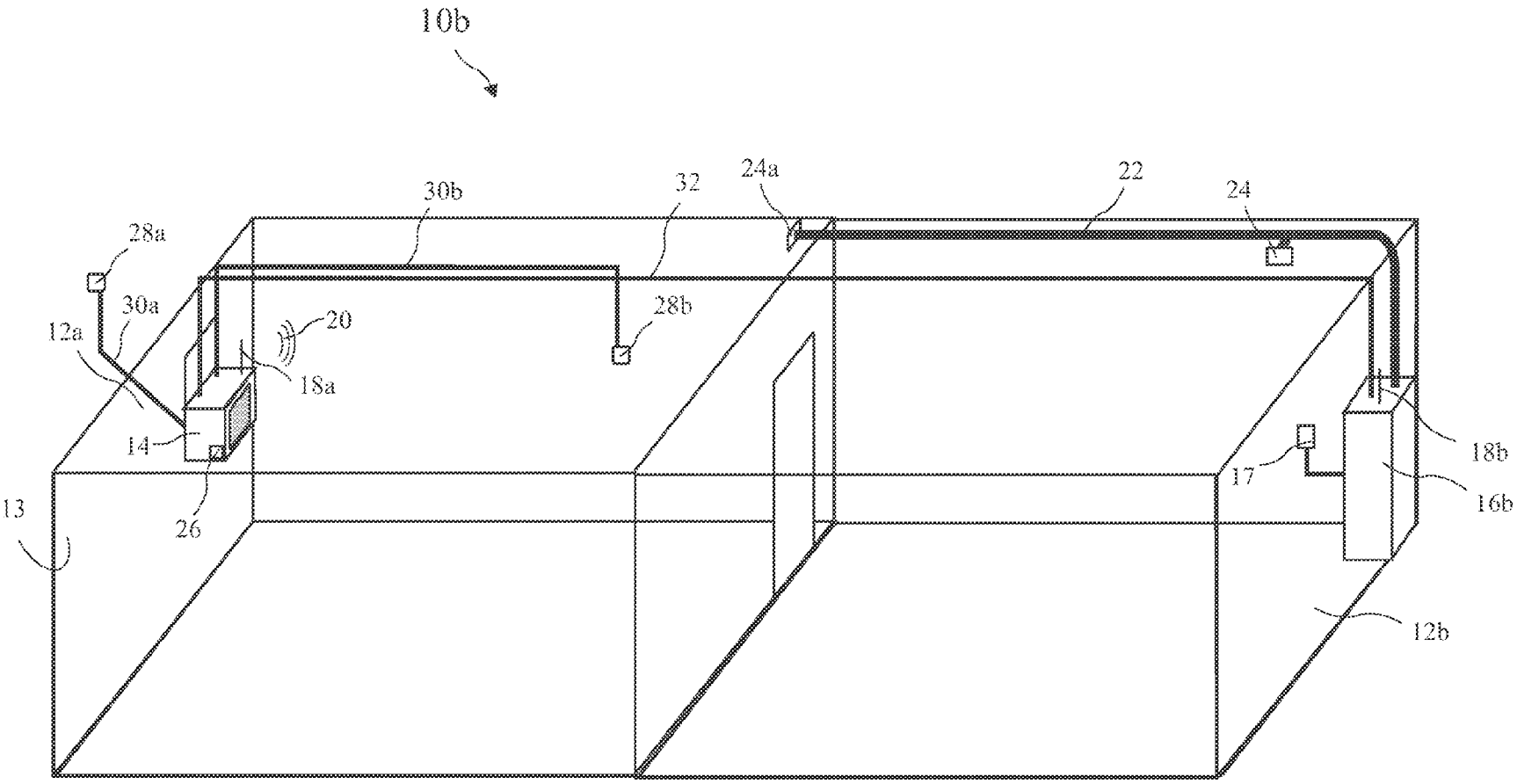
FIG. 2 shows rooms including a wall fan cooperating with a Heating, Ventilating, and Air Conditioning (HVAC) system according to the present invention.

A temperature controlled area 10*b* including two rooms 12*a* and 12*b* including the wall fan 14 cooperating with a Heating, Ventilating, and a temperature control unit comprising an Air Conditioning (HVAC) system 16*b* are shown in FIG. 2. The wall fan 14 is mounted to an external wall 13 of the room 12*a* and the HVAC system 16*b* resides in or proximal to the room 12*b*. The wall fan 14 may be mounted to any external wall, and is preferably mounted to an open window. The HVAC system 16*b* may be in either room, in a utility closet, in an attic, or on a roof of the temperature controlled area 10. An HVAC thermostat 17 normally controls the operation of the HVAC system 16*b*. Ducting 22 connects the HVAC 16*b* to vents 24*a* and 24*b* in the rooms 12*a* and 12*b* respectively providing either heated or cooled air. While an HVAC 16*b* using ducting and vents is shown, those skilled in the art will recognize that various heating and cooling systems are known, and such systems are intended to come within the scope of the present invention.

A control panel 26 may be mounted to the wall fan 14, be part of the wall fan 14, or mounted at any convenient location in the area 10. The control panel 26 allows a user to select heating or cooling and the desired temperatures Tl and Th. An outdoor temperature sensor 28*a* measures outdoor temperature To and in indoor temperature sensor measures an indoor temperature Ti. The temperatures Tl, Th, To, and Ti are all provided to a processor 50 (see FIG. 3). The processor 50 determines if the wall fan 14 should be energized or de-energized, and if the HVAC 16*b* should be de-energized or energized, based on the method of FIGS. 3 and 5. The control panel 26, sensors 28*a* and 28*b*, wall fan 14 and HVAC 16*b* may be connected by wires 30*a*, 30*b*, and 32. In a partially or totally wireless embodiment, some or all of the signals may be transmitted, for example, an antenna 18*a* connected to the processor 50 may transmit control signals 20 to a second antenna 18*b* electrically connected to the HVAC 16*b*.

FIG. 3 shows a heating method according to the present invention. The method includes: setting heating mode and a low temperature Tl and a high temperature Th at step 100; measuring an outdoor temperature To and an indoor temperature Ti at step 102; comparing To and Ti at step 104; If To is not greater than Ti at step 104, de-energize the wall fan and energize the temperature control unit at step 112, waiting a period of time P at step 114, and then repeating measuring the outdoor temperature To and the indoor temperature Ti, otherwise, if To is greater than Ti (i.e., can use outdoor air to heat the room), if Tl is less than Ti and Ti is less than Th at step 106, energizing the wall fan and de-energizing the temperature control unit at step 108 or alternatively de-energizing the wall fan and energizing the temperature control unit at step 110, and after the period of time P at step 114, again measuring the outdoor temperature To and the indoor temperature Ti and repeating steps 104 through 110. The temperature Tl is a lower preferred indoor temperature and the temperature Th is a higher preferred indoor temperature.

Figure 4:
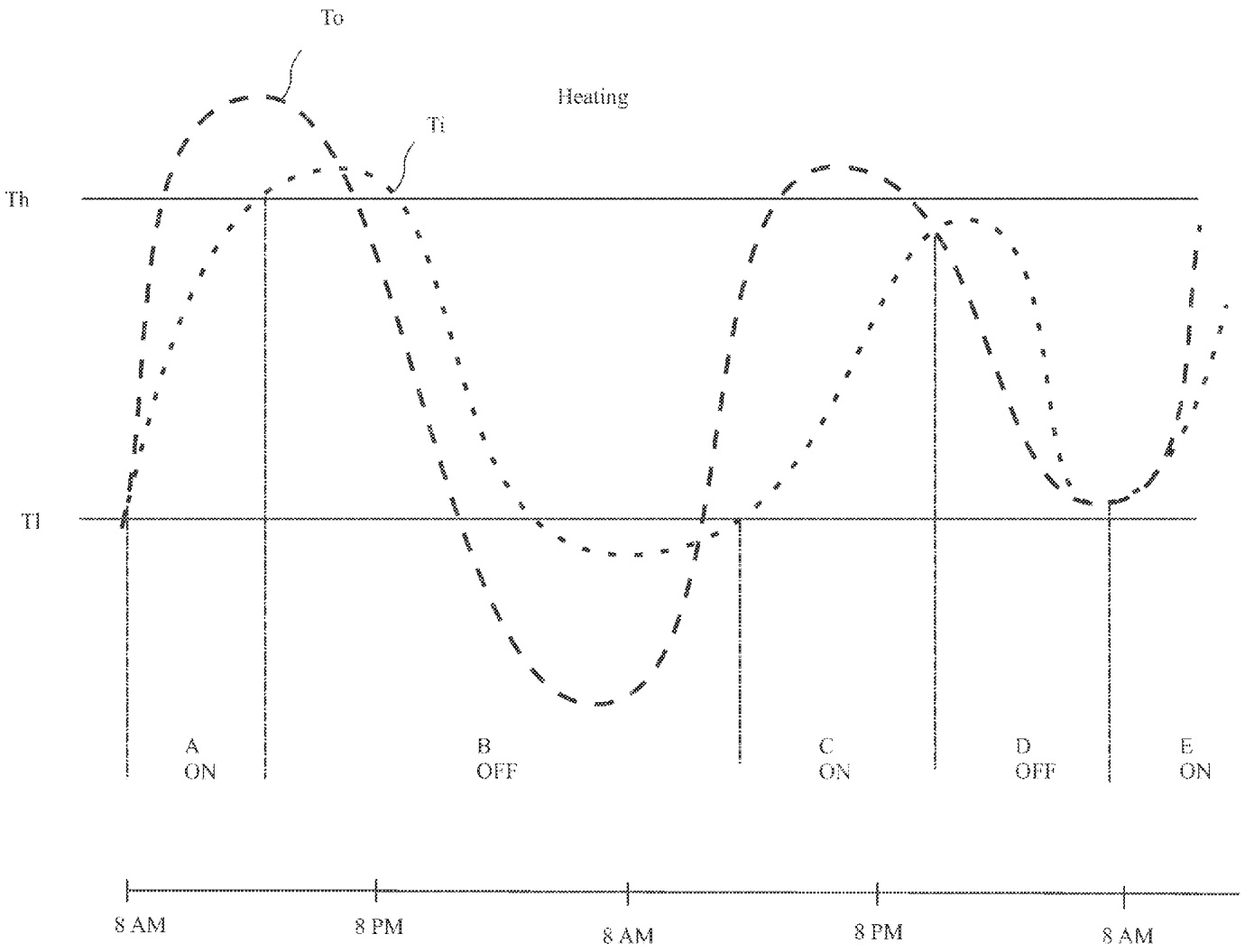
FIG. 4 shows the operation of the heating method according to the present invention.

FIG. 4 shows the method of FIG. 3 controlling a wall fan in heating mode. In interval A Ti is between Tl and Th, and To is greater than Ti, so the wall fan is energized to take advantage of the outdoor air to heat the room. During interval B Ti is greater than Th, or To is less than Ti and the wall fan is de-energize and a heater or HVAC system is energized. During interval C Ti remains between Tl and Th and To is greater than Ti, so the wall fan is energized to take advantage of the outdoor air to heat the room. During interval D To is less than Ti and the wall fan is de-energized and a heater or HVAC system is energized. During interval E, Ti remains between Tl and Th and To is greater than Ti, so the wall fan is energized to take advantage of the outdoor air to heat the room.

FIG. 5 shows a heating method according to the present invention. The method includes: setting cooling mode and the lower temperature Tl and the higher temperature at step 200; measuring an outdoor temperature To and an indoor temperature Ti at step 202; comparing Ti and To at step 204; If Ti is not greater than To at step 204, di energize the wall fan and the energize the temperature control unit at step 212, waiting a period of time P at step 214, and then repeating measuring the outdoor temperature To and the indoor temperature Ti, otherwise, if Ti is greater than To (i.e., can use outdoor to cool the room), if Tl is less than Ti and Ti is less than Th at step 206, energize the wall fan ON and de-energize the temperature control unit at step 208 or alternatively de-energize the wall fan and energize the temperature control unit at step 210, and after the period of time P at step 214, again measuring the outdoor temperature To and the indoor temperature Ti and repeating steps 204 through 210.

Figure 6:
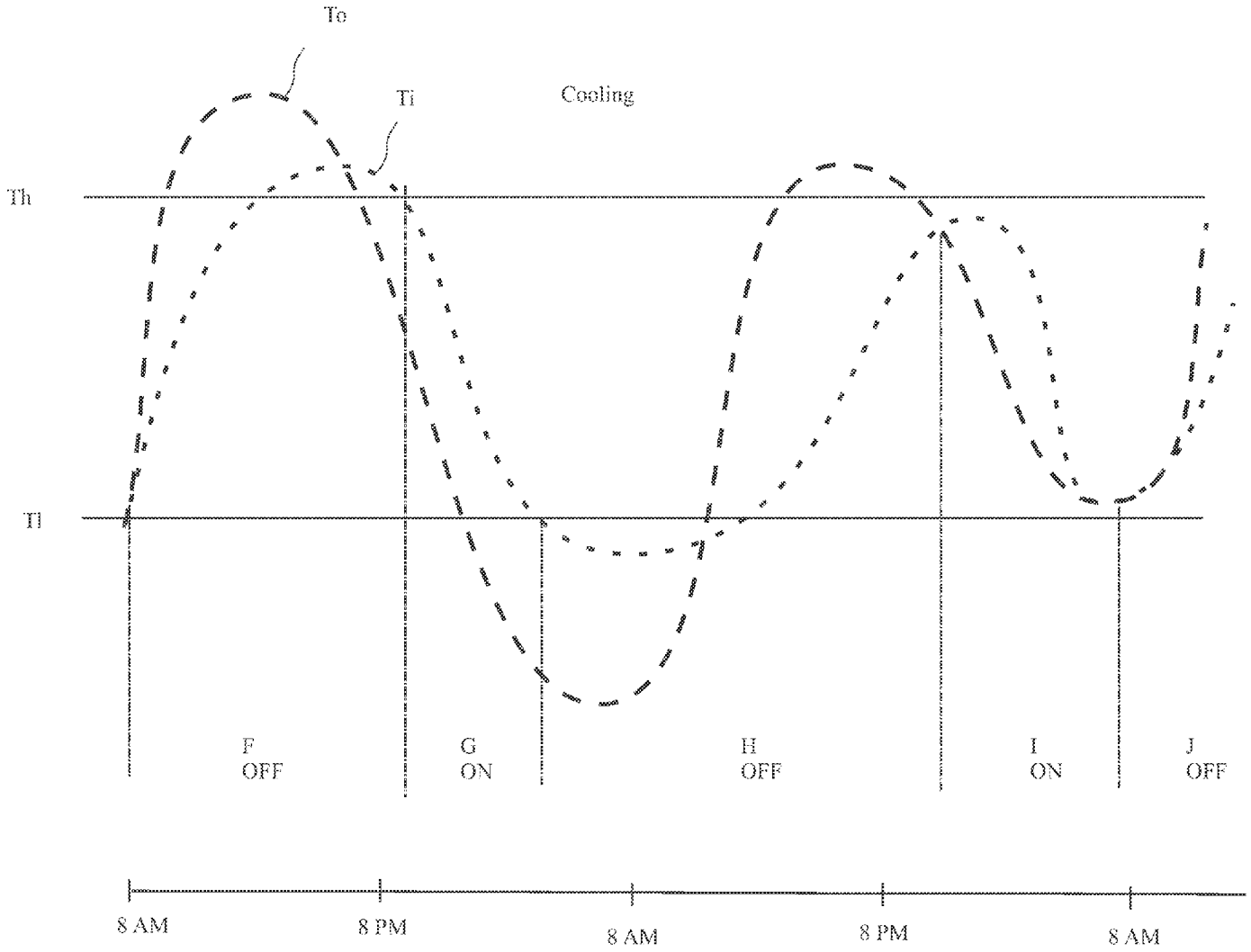
FIG. 6 shows the operation of the cooling method according to the present invention.

FIG. 6 shows the method of FIG. 5 controlling a wall fan in cooling mode. In interval F, either To is greater than Ti or Ti is greater than Th, so the wall fan is de-energized. During interval G, Ti is between Tl and Th, and To is less than Ti so the wall fan is energized to take advantage of cooler outdoor air. During interval H, either Ti is less than Tl or To is greater than Ti, so the wall fan is de-energized. During interval I, Ti is between Tl and Th, and To is less than Ti so the wall fan is energized to take advantage of cooler outdoor air. During interval J, To is greater than Ti, so the wall fan is de-energized.

Figure 7:
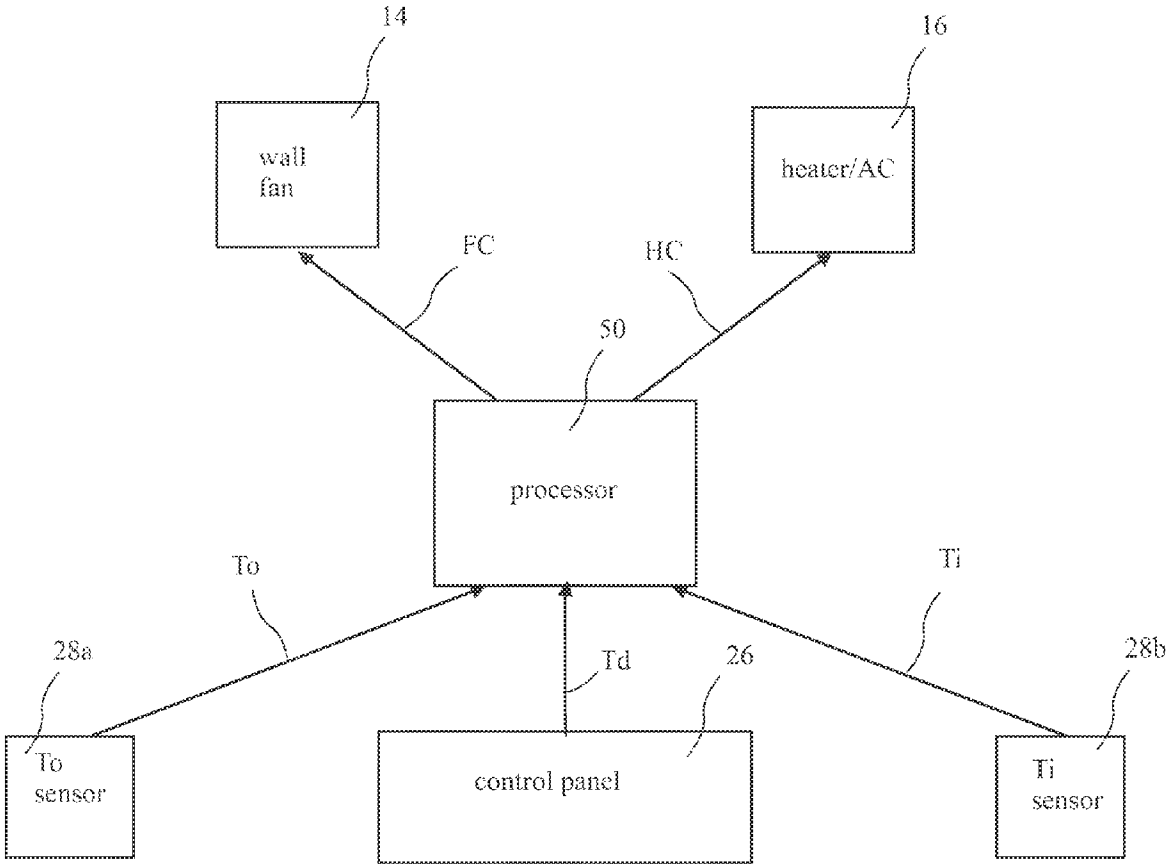
FIG. 7 shows a circuit according to the present invention.

A circuit according to the present invention for controlling the wall fan 14 and HVAC is shown in FIG. 7. The control panel 26, sensors 28*a* and 28*b*, wall fan 14 and HVAC 16*b* may be connected by wires or be wireless, for example Bluetooth, communications.

While the invention herein disclosed has been described by means of specific embodiments and applications thereof, numerous modifications and variations could be made thereto by those skilled in the art without departing from the scope of the invention set forth in the claims.

I claim:

1. A temperature controlled environment, comprising:

at least one room containing air having an air temperature;

a control panel configured to allow a user to input a lower temperature and a higher temperature;

an outdoor temperature sensor configured to measure an outdoor temperature;

an indoor temperature sensor configured to measure a temperature in the air in the room;

a wall fan on an exterior wall of the room configured to draw outdoor air into the room;

a heater in fluid communication with the room;

a processor operatively connected to the control panel, the indoor temperature sensor, the outdoor temperature sensor, the wall fan, and the temperature control unit, the processor configured to:

compare the indoor temperature to the outdoor temperature;

compare the indoor temperature to the lower temperature; and compare the indoor temperature to the higher temperature;

if the indoor temperature is lower than the outdoor temperature and the indoor temperature is lower than the higher temperature, then energize the wall fan and de-energize the heater;

if the indoor temperature is not lower than the outdoor temperature or the indoor temperature is not lower than the higher temperature, then de-energize the wall fan and energize the heater; and repeat comparing the indoor temperature to the outdoor temperature, the lower temperature, and the higher temperature after a period of time.

2. The system of claim 1, wherein the processor resides in a switch including a single pole double throw relay, and the double throw is controlled by the processor to provide power to the wall fan when the wall fan is energized and to the heater when the temperature control unit is energized.

3. The temperature controlled environment of claim 1, wherein energizing comprises providing electrical power.

4. The temperature controlled environment of claim 3, further including an electrical switch electrically connected to the control panel and to an electrical power source, wherein:

the electrical switch switchedly places one of the wall fan and the heater in electrical communication with the electrical power source to provide electrical power to one of one of the wall fan and the heater and not to the other of one of the wall fan and the heater; and the processor controls the electrical switch to select which of one of the wall fan and the heater to place in electrical communication with the electrical power source.

5. The temperature controlled environment of claim 4, wherein the electrical switch is a relay.

6. The temperature controlled environment of claim 5, wherein the electrical switch is a double throw relay.

7. The temperature controlled environment of claim 6, wherein the electrical switch is a single pole double throw relay.

8. The temperature controlled environment of claim 6, wherein the electrical switch is a single pole double throw relay.

9. The temperature controlled environment of claim 5, wherein the electrical switch is a double throw relay.

10. The temperature controlled environment of claim 4, wherein the electrical switch is a relay.

11. The temperature controlled environment of claim 1, wherein energizing comprises providing an electric power signal and de-energizing comprises removing the electric power signal.

12. The temperature controlled environment of claim 1, wherein:

if the indoor temperature is lower than the outdoor temperature and the indoor temperature is lower than the higher temperature, then energize the wall fan and de-energize the heater comprises, if the indoor temperature is lower than the outdoor temperature, and the indoor temperature is higher than the lower temperature, and the indoor temperature is lower than the higher temperature, then energize the wall fan and de-energize the heater; and if the indoor temperature is not lower than the outdoor temperature or the indoor temperature is not lower than the higher temperature, then de-energize the wall fan and energize the heater comprises, if the indoor temperature is not lower than the outdoor temperature or the indoor temperature is not higher than the lower temperature or the indoor temperature is not lower than the higher temperature, then de-energize the wall fan and energize the heater.

13. A method for controlling temperature in a temperature controlled environment including a heater, a cooler, and a Heating, Ventilating, and Air Conditioning (HVAC) system in fluid communication with at least one room in the temperature controlled environment providing heating to the room, the improvement comprising:

mounting a wall fan to an exterior wall, providing a control circuit;

mounting a control panel and electrically connecting the control panel to the control circuit;

position an outdoor temperature sensor in an outdoor location and electrically connecting the outdoor temperature sensor to the control circuit;

position an indoor temperature sensor in an indoor location and electrically connecting the indoor temperature sensor to the control circuit;

electrically connecting the control circuit to the temperature control unit;

a user setting a lower temperature and a higher temperature at the control panel;

measuring an outdoor temperature To and an indoor temperature Ti;

comparing the indoor temperature to the outdoor temperature;

comparing the indoor temperature to the lower temperature;

comparing the indoor temperature to the higher temperature;

if the indoor temperature is lower than the outdoor temperature and the indoor temperature is lower than the higher temperature set by the user, then energizing the wall fan and de-energizing the heater;

if the indoor temperature is not lower than the outdoor temperature or the indoor temperature is not lower than the higher temperature, then de-energizing the wall fan and energizing the heater; and repeat comparing the indoor temperature to the outdoor temperature, the lower temperature, and the higher temperature after a period of time.

14. The temperature controlled environment of claim 13, wherein energizing comprises providing an electric power signal to the heater and de-energizing comprises removing the electric power signal from the heater.

15. The method of claim 13, wherein energizing and de-energizing comprises switching at least one relay.

16. The method of claim 15, wherein switching at least one relay comprises switching a double throw relay.

17. The method of claim 15, wherein switching a double throw relay comprises switching a single pole double throw relay.

18. The method of claim 13, wherein:

if the indoor temperature is lower than the outdoor temperature and the indoor temperature is lower than the higher temperature set by the user, then energizing the wall fan and de-energizing the heater comprises, if the indoor temperature is lower than the outdoor temperature and the indoor temperature is higher than the lower temperature set by the user and the indoor temperature is lower than the higher temperature set by the user, then energizing the wall fan and de-energizing the heater;

if the indoor temperature is not lower than the outdoor temperature or the indoor temperature is not lower than the higher temperature, then de-energizing the wall fan and energizing the heater comprises, if the indoor temperature is not lower than the outdoor temperature, or the indoor temperature is not higher than the lower temperature, or the indoor temperature is not lower than the higher temperature, then de-energizing the wall fan and energizing the heater.

19. A method for controlling temperature in a temperature controlled environment including a cooler in fluid communication with at least one room in the temperature controlled environment providing cooling to the room, the improvement comprising:

mounting a wall fan to an exterior wall, providing a control circuit;

mounting a control panel and electrically connecting the control panel to the control circuit;

position an outdoor temperature sensor in an outdoor location and electrically connecting the outdoor temperature sensor to the control circuit;

position an indoor temperature sensor in an indoor location and electrically connecting the indoor temperature sensor to the control circuit;

electrically connecting the control circuit to the temperature control unit;

a user setting a lower temperature and a higher temperature at the control panel;

measuring an outdoor temperature To and an indoor temperature Ti;

comparing the indoor temperature to the outdoor temperature;

comparing the indoor temperature to the lower temperature;

comparing the indoor temperature to the higher temperature;

if the indoor temperature is higher than the outdoor temperature, and the indoor temperature is lower than the higher temperature set by the user, and the indoor temperature is higher than the lower temperature set by the user, then energizing the wall fan and de-energizing the cooler;

if the indoor temperature is not higher than the outdoor temperature, or the indoor temperature is not higher than the lower temperature, or the indoor temperature is not lower than the higher temperature, then de-energizing the wall fan and energizing the cooler; and repeat comparing the indoor temperature to the outdoor temperature, the lower temperature, and the higher temperature after a period of time.

* * * * *